US010772427B2

(12) United States Patent
Schuppler et al.

(10) Patent No.: US 10,772,427 B2
(45) Date of Patent: Sep. 15, 2020

(54) SEATING FURNITURE

(71) Applicant: VS VEREINIGTE SPEZIALMOEBELFABRIKEN GMBH & CO. KG, Tauberbischofsheim (DE)

(72) Inventors: Markus Schuppler, Lauda-Koenigshofen (DE); Michael Scheller, Triefenstein (DE); Jens Heller, Gruensfeld (DE)

(73) Assignee: VS Vereinigte Spezialmoebelfabriken GmbH & Co. KG, Tauberbischofsheim (DE)

( * ) Notice: Subject to any disclaimer, the term of this patent is extended or adjusted under 35 U.S.C. 154(b) by 0 days.

(21) Appl. No.: 16/334,799

(22) PCT Filed: Sep. 13, 2017

(86) PCT No.: PCT/EP2017/072986
§ 371 (c)(1),
(2) Date: Mar. 20, 2019

(87) PCT Pub. No.: WO2018/054731
PCT Pub. Date: Mar. 29, 2018

(65) Prior Publication Data

US 2020/0000231 A1 Jan. 2, 2020

(30) Foreign Application Priority Data

Sep. 20, 2016 (DE) ..... 10 2016 217 992

(51) Int. Cl.
*A47C 7/14* (2006.01)
*A47C 1/032* (2006.01)
(Continued)

(52) U.S. Cl.
CPC ..... *A47C 1/03261* (2013.01); *A47C 3/30* (2013.01); *A47C 7/004* (2013.01); *A47C 7/006* (2013.01); *A47C 7/14* (2013.01)

(58) Field of Classification Search
CPC ..... A47C 7/14; A47C 7/144; A47C 7/004; A47C 9/002; A47C 1/03261;
(Continued)

(56) References Cited

U.S. PATENT DOCUMENTS 1,358,640 A * 11/1920 Koyama ..... A47C 9/002 114/188
4,099,697 A * 7/1978 Von Schuckmann ..... A47C 3/026 248/398

(Continued)

FOREIGN PATENT DOCUMENTS

CH 698900 A2 11/2009
EP 1584266 B1 10/2010

(Continued)

*Primary Examiner* — Kyle J. Walraed-Sullivan
(74) *Attorney, Agent, or Firm* — Laurence A. Greenberg; Werner H. Stemer; Ralph E. Locher

(57) ABSTRACT

A seating furniture includes a seat with a seat surface, a pedestal and a tilt mechanism. The tilt mechanism is disposed between the pedestal and the seat and permits an inclination of the seat surface of the seat relative to the horizontal. In addition, the tilt mechanism has a lower bearing block mounted to the pedestal, and an upper bearing block fixedly connected to the seat. The lower bearing block has a convexly curved lower bearing surface on its upper side facing the upper bearing block, and the upper bearing block has a concavely curved upper bearing surface on its lower side facing the lower bearing block. The lower and upper bearing surfaces have substantially corresponding radii of curvature, so that the upper bearing block can be moved relative to the lower bearing block along the upper
(Continued)

bearing surface. A tilt mechanism for seating furniture is also provided.

16 Claims, 2 Drawing Sheets

(51) Int. Cl.
*A47C 3/30* (2006.01)
*A47C 7/00* (2006.01)

(58) Field of Classification Search
CPC ..... A47C 1/03255; A47C 1/03266; A47C 1/03288; A47C 1/033; A47C 3/30; A47C 3/027; A47C 3/026; A47C 3/0255; A47C 3/0257; A47C 3/0252
USPC ..... 297/313, 314
See application file for complete search history.

(56) References Cited

U.S. PATENT DOCUMENTS 4,974,904 A * 12/1990 Phillips ..... A47C 9/002 297/258.1
5,590,930 A * 1/1997 Glockl ..... A47C 3/0257 297/258.1
5,728,049 A * 3/1998 Alberts ..... A47C 9/002 297/314
6,209,958 B1 * 4/2001 Thole ..... A47C 3/026 297/302.1
7,396,080 B2 7/2008 Suhr et al.
2009/0188410 A1 * 7/2009 Billich ..... A47C 3/0255 108/4
2009/0261642 A1 * 10/2009 Dickie ..... A47C 7/446 297/314
2011/0089733 A1 * 4/2011 Nishino ..... A47C 3/0257 297/258.1
2012/0292968 A1 * 11/2012 Lee ..... A47C 7/14 297/313
2013/0241253 A1 * 9/2013 Harrison ..... A47C 1/027 297/258.1
2014/0162859 A1 * 6/2014 Cheng ..... A63B 26/003 482/142
2015/0173515 A1 6/2015 Freedman
2016/0311536 A1 * 10/2016 Schultheis ..... A47C 7/14
2018/0271289 A1 * 9/2018 Gregory ..... A47C 3/26
2019/0104851 A1 * 4/2019 Carey ..... A47C 7/144

FOREIGN PATENT DOCUMENTS

IE 202013102570 U1 6/2013
WO 9014031 A1 11/1990
WO 2016074784 A1 5/2016

* cited by examiner

SEATING FURNITURE

BACKGROUND OF THE INVENTION

Field of the Invention

The present invention relates to a seating furniture comprising a tilt mechanism as well as a tilt mechanism for such a seating furniture.

Seating furniture typically comprises a seat having a seat surface and a pedestal. A seat surface tiltable relative to the horizontal enables an active-dynamic and thus ergonomic sitting for the user. F or this purpose, it is known to arrange a so-called tilt mechanism between the pedestal and the seat, which is designed to allows the seat surface of the seat to tilt relative to the horizontal in one or more directions.

EP 1 584 266 B1 discloses such a tilt mechanism which allows the seat surface to tilt relative to the horizontal in both a front/rear direction of the seat surface and a right/left direction of the seat surface. For this, the tilt mechanism comprises a pressure plate having a first conicity in the front/rear direction of the seat surface by which the seat can tilt in the front/rear direction, and a second conicity in the right/left direction of the seat surface by which the seat can tilt in the right/left direction.

WO 2016/074784 A1 describes a tilt mechanism for an office chair which comprises two bearing parts arranged movable relative to each other and having bearing shells being curved correspondingly to each other for mutual bearing, which are tiltable relative to each other in a predetermined angular range by a shift of weight of a user on the seat surface.

SUMMARY OF THE INVENTION

It is the object of the invention to provide a seating furniture having a simply designed and smooth-running tilt mechanism.

This object is achieved by the teaching of the independent claims. Some advantageous configurations of the invention are the subject of the dependent claims.

The seating furniture according to the invention comprises a seat having a seat surface, a pedestal and a tilt mechanism. The tilt mechanism is arranged between the pedestal and the seat and is designed to allow the seat surface of the seat to tilt relative to the horizontal. The tilt mechanism comprises a lower bearing block mounted on the pedestal and an upper bearing block fixedly connected to the seat. According to the invention, the seating furniture is characterized in that the lower bearing block has a convex curved lower bearing surface on its upper side facing towards the upper bearing block, and the upper bearing block has a concave curved upper bearing surface on its lower side facing towards the lower bearing block, wherein the lower bearing surface of the lower bearing block and the upper bearing surface of the upper bearing block have substantially identical radii of curvature, and wherein the upper bearing block is moveable relative to the lower bearing block along the upper bearing surface.

The seating furniture of the invention having the specifically designed tilt mechanism enables an ergonomic sitting for the user.

The tilt mechanism of the inventive seating furniture is designed simple and with few components. By this, the weight of the tilt mechanism and the entire seating furniture can be reduced.

By moving the two curved bearing surfaces of the two bearing blocks relative to each other, a tilting of the seat surface is smooth-running and thus comfortable for the user. Also, the moving of the two curved bearing surfaces of the two bearing blocks relative to each other is relatively low-wear in comparison to conventional structures of the tilt mechanism so that the tilt mechanism can have a long service life.

The seating furniture is preferably an office chair or a student chair. In addition, the seating furniture is preferably designed as a swivel chair. The seat has a seat surface and preferably also a backrest. The seat surface and backrest can then be designed as a common component or as two separately formed, interconnected components.

The lower bearing block of the tilt mechanism is mounted on the pedestal, i.e. immovable connected with it. The connection can be made detachable or permanent. The upper bearing block of the tilt mechanism is directly or indirectly (e.g. via a seat carrier) fixed, i.e. immovably connected to the seat. The connection can be made detachable or permanent.

The seat surface of the seat defines in particular a front/rear direction and a right/left direction. The tilt mechanism allows the seat surface to tilt relative to the horizontal in at least one direction (e.g. front/rear direction of the seat surface), preferably in several directions (e.g. in both the front/rear direction and the right/left direction of the seat surface). The tilting of the seat surface in several directions can preferably be made continuously in the circumferential direction (e.g. gyroscopic motion), alternatively only in different discrete directions.

In an advantageous configuration of the invention, the tilt mechanism further comprises an intermediate element which is arranged between the lower bearing surface and the upper bearing surface. This intermediate element preferably reduces a sliding resistance between the lower and upper bearing surfaces in a relative movement between the lower and upper bearing blocks. With such an intermediate element, tilting of the seat surface can be made very smooth-running and quiet. In addition, such an intermediate element can extend the service life of the tilt mechanism.

In an advantageous configuration of the invention, the intermediate element of the tilt mechanism is placed on the lower bearing surface (e.g. unmounted set or fixed on the lower bearing surface) and has a reduced sliding resistance on its upper side facing towards the upper bearing surface. Alternatively, the intermediate element may also be provided on the upper bearing surface and have a reduced sliding resistance on its lower side facing towards the lower bearing surface.

Preferably, the intermediate element of the tilt mechanism is curved convexly on its upper side and curved concavely on its lower side facing towards the lower bearing surface. Preferably, the radii of curvature of the upper and lower sides of the intermediate element coincide with the radii of curvature of the upper and lower bearing surfaces of the bearing blocks.

In an advantageous configuration of the invention, the pedestal of the seating furniture comprises a pillar having a gas spring, wherein the gas spring is operable by a user by means of an operating. In this configuration, the intermediate element of the tilt mechanism preferably comprises a stop for a movement of the operating lever or forms such a stop. In other configurations of the invention, the pedestal of the seating furniture has a simple pillar, a threaded spindle, etc.

In another advantageous configuration of the invention, the tilt mechanism further comprises a housing in which the lower bearing block and the upper bearing block are at least partially contained. The housing protects the components of the tilt mechanism against dirt and damage and protects the user against catching between the movable parts of the tilt mechanism.

Preferably, the housing of the tilt mechanism is fixedly connected to the upper bearing block and movable relative to the lower bearing block.

In an advantageous configuration of the invention, the pedestal of the seating furniture comprises a pillar having a gas spring. In this configuration, the housing of the tilt mechanism preferably has a housing opening for passing an operating lever for the gas spring of the pillar. In other configurations of the invention, the pedestal of the seating furniture has a simple pillar, a threaded spindle, etc.

In another advantageous configuration of the invention, the tilt mechanism further comprises at least one elastic element which generates a spring effect opposing the relative movement between the lower and upper bearing blocks. The elastic element dampens the tilting movement of the seat surface in the various directions and supports a return of the seat surface into the neutral position. The elastic element also enables a stop-free tilt limit and thus an elimination of impact noises at intense tiltings of the seat surface. The elastic element is preferably a spring block, i.e. a block made of an elastic material. Thus, the spring effect can be achieved by compressing the elastic element, and the stop-free tilt limit can be achieved by the maximum compression of the elastic element. The at least one elastic element is preferably designed as an annular spring block or as a plurality of annularly arranged spring blocks.

In an advantageous configuration of the invention, this at least one elastic element of the tilt mechanism is arranged between the lower bearing block and the housing. Preferably, the lower bearing block has a circumferential projection, and the elastic element is arranged between a lower side of this circumferential projection facing away from the upper bearing block and a lower housing wall.

In another advantageous configuration of the invention, the tilt mechanism enables different maximum tilt angles in various tilt directions. For example, the tilt mechanism allows the seating surface of the seat to tilt relative to the horizontal in the front/rear direction of the seat surface by a maximum of about 8 degrees and to tilt relative to the horizontal in the right/left direction of the seat surface by a maximum of about 3.5 degrees.

Subject-matter of the present invention is also a tilt mechanism itself which can be arranged between a pedestal and a seat of a seating furniture and is designed to allow the seat surface of the seat to tilt relative to the horizontal in several directions. The tilt mechanism of the invention is configured as above in connection with the seating furniture of the invention and gives the same advantages.

BRIEF DESCRIPTION OF THE SEVERAL VIEWS OF THE DRAWING

The above and other advantages, features and application possibilities of the invention will become more apparent from the following description of various embodiments with reference to the accompanying drawings, in which, mostly schematically.

DESCRIPTION OF THE INVENTION

Figure 1:
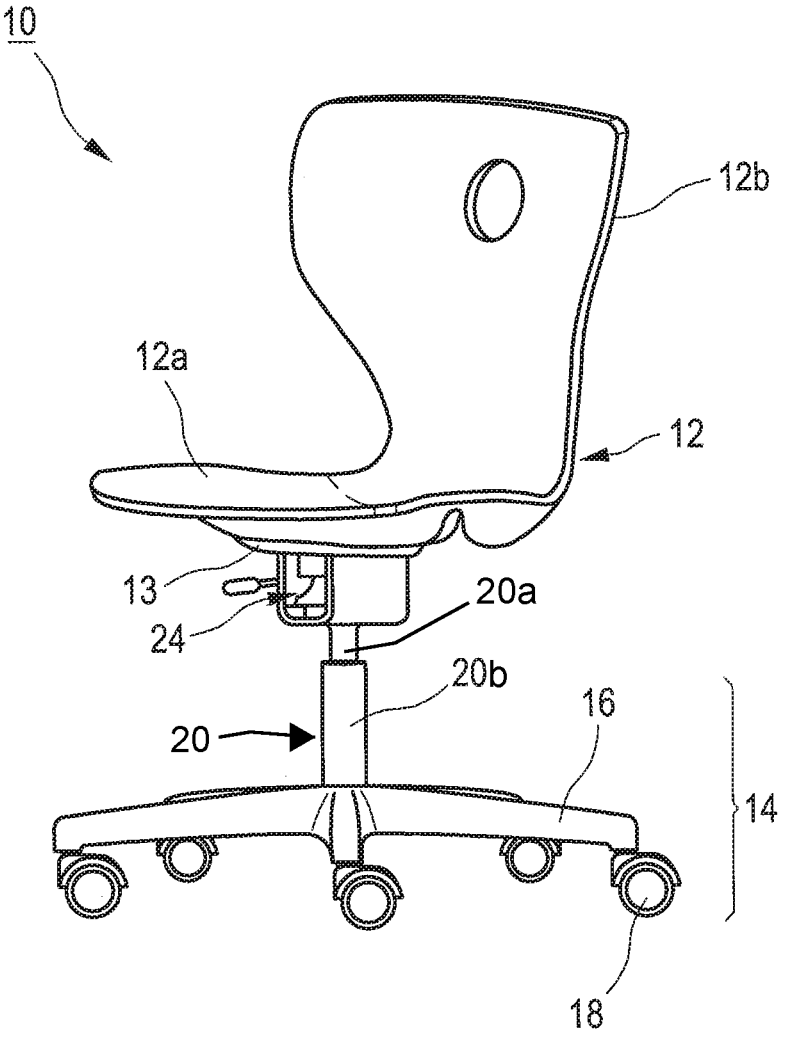
FIG. 1 is a perspective view of a seating furniture according to an embodiment of the invention.

FIG. 1 exemplarily shows an office or school chair as a seating furniture 10 of the invention.

The seating furniture 10 comprises a seat 12 having a seat surface 12*a* and a backrest 12*b*. In this embodiment, the seat surface 12*a* and the backrest 12*b* are designed in the form of a common seat shell; In other embodiments of the invention, the seat surface 12*a* and the backrest 12*b* may also be designed as separate components connected to each other. In this embodiment, the seat 12 is made of a plastic material; in other embodiments of the invention, other materials or combinations of materials may also be used.

The seat 12 is mounted on a seat carrier 13 and supported on a pedestal 14. In this embodiment, the pedestal 14 comprises a pedestal base 16 having a plurality of arms and casters 18. In the middle of the pedestal base 16, the pedestal 14 has a pillar 20. In this embodiment, the pillar 20 is equipped with a piston 20*a* and a gas spring 20*b* so that the seating furniture 10 is adjustable in height.

A tilt mechanism 24 is provided between the pedestal 14 and the seat 12 or the seat carrier 13. This tilt mechanism 24 allows the seating surface 12*a* of the seat 12 tilt relative to the horizontal in a plurality of directions, in particular in a front/rear direction of the seat surface 12*a* and a right/left direction of the seat surface 12*a* (either continuously in the circumferential direction or in discrete directions) so that an ergonomic sitting can be achieved for a user of the seat furniture 10.

The structure and operation of such a tilt mechanism are explained below in more details referring to a preferred embodiment of the invention with reference to FIG. 2.

Figure 2:
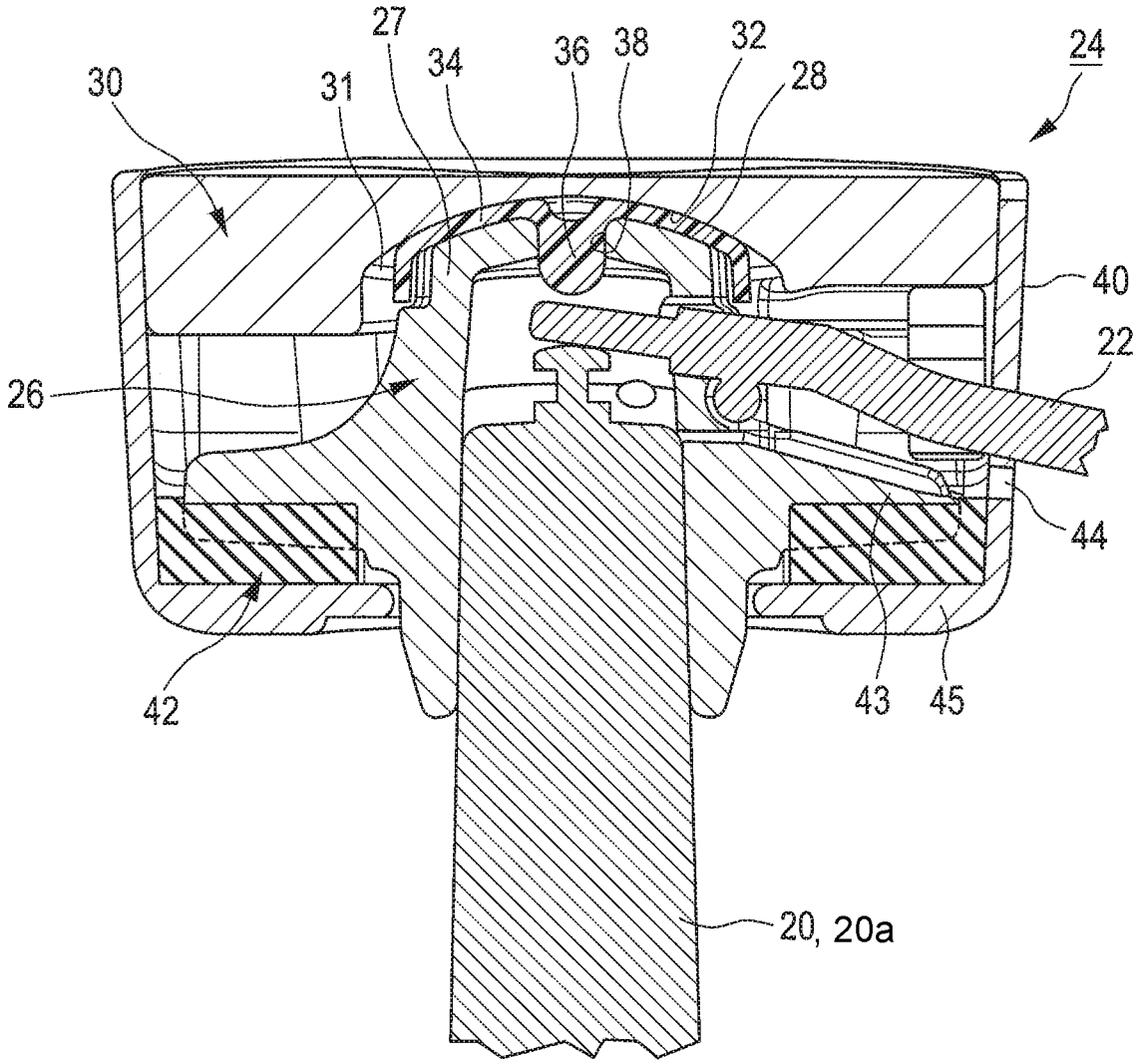
FIG. 2 is a sectional view of a tilt mechanism according to an embodiment of the invention.

FIG. 2 shows an upper end of the pillar 20 of the pedestal 14, which is equipped with a gas spring, and an inner end of a corresponding operating lever 22 for the gas spring, with which a user can operate the gas spring to change the length of the pillar 20 and thus the height of the seat surface 12*a* as he wishes.

The tilt mechanism 24 comprises a lower bearing block 26 made of metal, for example. This lower bearing block 26 is mounted on the upper end of the pillar 20, for example placed by press-fitting. On its upper side facing towards the seating surface 12*a*, the lower bearing block 26 has a central projection 27 which is provided with a convex curved lower bearing surface 28. This lower bearing surface 28 is designed particularly as a spherical shell section with a predetermined radius of curvature.

The tilt mechanism 24 further comprises an upper bearing block 30 made of metal, for example. On this upper bearing block 30, the seat carrier 13 and thus the seat 12 are mounted, for example by means of a screw connection. At its lower side facing towards the lower bearing block 26, the upper bearing block 30 is formed with a central recess 31 which is provided with a concave curved upper bearing surface 32. This upper bearing surface 32 is designed particularly as a spherical shell section with a predetermined radius of curvature which is substantially identical to the radius of curvature of the lower bearing surface 28 of the lower bearing block 26. The upper bearing surface 32 is preferably formed as a full-surface bearing surface (in contrast to annular bearing surfaces, for example).

As shown in FIG. 2, the lower and upper bearing surfaces 28, 32 are slightly spaced apart from each other. In this preferred embodiment, an intermediate member 34 in the form of a sliding cap is inserted between the lower bearing surface 28 at the lower bearing block 26 and the upper bearing surface 32 at the upper bearing block 30.

In the embodiment of FIG. 2, the intermediate element 34 is placed on the lower bearing surface 28 of the lower bearing block 26. The intermediate element is curved convexly on its upper side facing towards the upper bearing surface 32 and curved concavely on its lower side facing towards the lower bearing surface 28. The radii of curvature of the intermediate element 34 are substantially identical to the radii of curvature of the bearing surfaces 28, 32. The upper side of the intermediate element 34 preferably forms an at least almost full-surface bearing surface.

The central projection 27 of the lower bearing block 26 is formed with at least one recess 38. The intermediate element 34 is formed with at least one projection 36 which can engage into the at least one recess 38, on its lower side. Thus, the intermediate element 34 can be fixed by press-fitting to the projection 27 of the lower bearing block 26. Alternatively or additionally, for example, an adhesive bond may be used. Alternatively, the intermediate element 34 may also be placed only loosely on the lower bearing surface 28 or loosely placed on the lower bearing surface 28 and then glued to this.

On its upper side, the intermediate element 34 has a reduced sliding resistance. That is, the sliding resistance between the upper side of the intermediate member 34 and the upper bearing surface 32 is reduced compared to the sliding resistance between the upper bearing surface 32 and the lower bearing surface 28. For this purpose, the intermediate element 34 is preferably made of a plastic material; in addition, the upper side of the intermediate element 34 may be specifically prepared and/or coated.

The projection 36 of the intermediate member 34 projecting into the recess 38 of the projection 27 of the lower bearing block 26 serves, as illustrated in FIG. 2, at the same time as a stop for the inner end of the operating lever 22 for the gas spring of the pillar 20. Thus, the intermediate element 34 limits the route of the operating lever 22 and prevents its abutment against the lower bearing block 26. In this way, noises caused by the abutment of the operating lever 22 with the lower bearing block 26, which are usually both made of metal, can be prevented.

The lower bearing block 26 and the upper bearing block 30 are surrounded by a housing 40. The housing 40 is made of metal or plastic, for example. The housing 40 is part of the tilt mechanism 24 and mounted on the upper bearing block 30.

In this embodiment, the housing 40 has a housing opening 44 for passing the operating lever 22 for the gas spring.

The lower bearing block 26 comprises a circumferential projection 43 and the housing 40 comprises a lower housing wall 45 as the lower boundary of the housing 40. The tilt mechanism 24 further comprises at least one elastic element 42, which is formed as an annular spring block made of an elastic material, in this embodiment. This elastic element 42 is positioned between the lower side of the circumferential projection 43 of the lower bearing block 26 and the lower housing wall 45 of the housing 40.

When the user moves his weight on the seating surface, the upper bearing block 30 of the tilt mechanism 24, which is fixedly connected to the seating surface 12*a* via the seat carrier 13, moves along its upper bearing surface 32 relative to the intermediate element 34 and thus relative to the lower bearing block 26. By this, the seat surface 12*a* tilts relative to the horizontal.

Due to the intermediate element 34 between the two corresponding bearing surfaces 28, 32, this tilting movement is smooth-running and quiet-running.

In other embodiments, it is also possible to omit the intermediate element 34 between the bearing surfaces 28, 32 of the two bearing blocks 26, 30. In this case, at least one of the two bearing surfaces 28, 32 is preferably treated or coated in order to reduce a sliding resistance between the two bearing surfaces 28, 32.

During this tilting movement, the housing 40 of the tilt mechanism 24, which is fixedly connected to the upper bearing block 30, is also moved relative to the lower bearing block 26. As consequence, the elastic element 42 is compressed on one side and thus generates a spring force opposing the tilt. The maximum tilt is given by the maximum compression of the elastic element 42. An abutment of the housing 40 against the lower bearing block 26 is also prevented by the elastic member 42. In addition, the elastic element 42 supports a return of the seat surface 12*a* to the neutral position.

The elastic element 42 may also have different elastic properties along its circumference, in particular different maximum degrees of compression. Thus, it is easily possible that the seat surface 12*a* has different maximum tilt angles in various tilt directions. For example, the tilt mechanism 24 allows the seating surface 12*a* of the seat 12 to tilt in the front/rear direction of the seat surface 12*a* by about 8 degrees at maximum relative to the horizontal, tilt in the right/left direction of the seat surface 12*a* by about 3.5 degrees at maximum relative to the horizontal.

LIST OF REFERENCE SIGNS

10 seating furniture
12 seat
12*a* seat surface
12*b* backrest
13 seat carrier
14 pedestal
16 pedestal base
18 casters
20 pillar, esp. having a gas spring
22 operating lever, esp. gas spring lever
24 tilt mechanism
26 lower bearing block
27 projection
28 convex curved lower bearing surface
30 upper bearing block
31 recess
32 concave curved upper bearing surface
34 intermediate element
36 projection
38 recess
40 housing
42 elastic element, esp. spring block
43 circumferential projection
44 housing opening
45 lower housing wall

The invention claimed is:

1. A seating furniture, comprising:

a seat having a seat surface;

an operating lever being operable by a user;

a pedestal including a pillar having a gas spring being operable by said operating lever; and a tilt mechanism disposed between said pedestal and said seat and configured to allow said seat surface of said seat to tilt relative to the horizontal;

said tilt mechanism including a lower bearing block mounted on said pedestal and an upper bearing block fixedly connected to said seat;

said lower bearing block including an upper side facing towards said upper bearing block and a convexly curved lower bearing surface on said upper side;

said upper bearing block including a lower side facing towards said lower bearing block and a concavely curved upper bearing surface on said lower side;

said convexly curved lower bearing surface of said lower bearing block and said concavely curved upper bearing surface of said upper bearing block having substantially identical radii of curvature;

said upper bearing block being moveable relative to said lower bearing block along said concavely curved upper bearing surface;

said tilt mechanism including an intermediate element disposed between said convexly curved lower bearing surface and said concavely curved upper bearing surface, said intermediate element having an upper side facing towards said concavely curved upper bearing surface, providing a sliding resistance between said upper side of said intermediate element and said concavely curved upper bearing surface being lower than a sliding resistance between said convexly curved lower and concavely curved upper bearing surfaces in a relative movement between said lower and upper bearing blocks;

said upper side of said lower bearing block facing towards said seat surface, said upper side of said lower bearing block having a central projection being provided with said convexly curved lower bearing surface and being formed with a recess; and said intermediate element having a projection projecting into said recess of said central projection of said lower bearing block and forming a stop for a movement of said operating lever.

2. The seating furniture according to claim 1, wherein said intermediate element of said tilt mechanism has upper and lower sides, and said intermediate element is convexly curved on said upper side and is concavely curved on said lower side facing towards said convexly curved lower bearing surface.

3. The seating furniture according to claim 1, wherein said tilt mechanism includes a housing at least partially containing said lower bearing block and said upper bearing block.

4. The seating furniture according to claim 3, wherein said housing of said tilt mechanism is fixedly connected to said upper bearing block and is movable relative to said lower bearing block.

5. The seating furniture according to claim 3, wherein said housing of said tilt mechanism has a housing opening for passage of said operating lever for operating said gas spring of said pillar.

6. The seating furniture according to claim 3, wherein said tilt mechanism includes at least one elastic element generating a spring effect opposing said relative movement between said lower and upper bearing blocks.

7. The seating furniture according to claim 6, which further comprises a housing at least partially containing said lower bearing block and said upper bearing block, said at least one elastic element of said tilt mechanism being disposed between said lower bearing block and said housing.

8. The seating furniture according to claim 1, wherein said tilt mechanism allows various tilt directions each having a maximum tilt angle, and the maximum tilt angles for the various tilt directions differ from each other.

9. A tilt mechanism to be disposed between a pedestal and a seat of a seating furniture for allowing a seat surface of the seat to tilt relative to the horizontal, the tilt mechanism comprising:

a lower bearing block to be mounted to the pedestal and an upper bearing block to be fixedly connected to the seat;

said lower bearing block having an upper side facing towards said upper bearing block and a convexly curved lower bearing surface on said upper side;

said upper bearing block having a lower side facing towards said lower bearing block and a concavely curved upper bearing surface on said lower side;

said convexly curved lower bearing surface of said lower bearing block and said concavely curved upper bearing surface of said upper bearing block have substantially identical radii of curvature;

said upper bearing block being moveable relative to said lower bearing block along said concavely curved upper bearing surface;

an operating lever being operable by a user for operating a gas spring of a pillar of the pedestal; and an intermediate element disposed between said convexly curved lower bearing surface and said concavely curved upper bearing surface, said intermediate element having an upper side facing towards said concavely curved upper bearing surface, providing a sliding resistance between said upper side of said intermediate element and said concavely curved upper bearing surface being lower than a sliding resistance between said convexly curved lower and concavely curved upper bearing surfaces in a relative movement between said lower and upper bearing blocks;

said upper side of said lower bearing block facing towards said seat surface, said upper side of said lower bearing block having a central projection being provided with said convexly curved lower bearing surface and being formed with a recess; and said intermediate element having a projection projecting into said recess of said central projection of said lower bearing block forming a stop for a movement of said operating lever.

10. The tilt mechanism according to claim 9, wherein said intermediate element has upper and lower sides, and said intermediate element is convexly curved on said upper side and is concavely curved on said lower side facing towards said convexly curved lower bearing surface.

11. The tilt mechanism according to claim 9, which further comprises a housing at least partially containing said lower bearing block and said upper bearing block.

12. The tilt mechanism according to claim 11, wherein said housing is fixedly connected to said upper bearing block and is movable relative to said lower bearing block.

13. The tilt mechanism according to claim 11, wherein said housing of said tilt mechanism has a housing opening for passage of said operating lever for operating a said gas spring of a said pillar of said pedestal.

14. The tilt mechanism according to claim 11, which further comprises at least one elastic element generating a spring effect opposing said relative movement between said lower and upper bearing blocks.

15. The tilt mechanism according to claim 14, which further comprises a housing at least partially containing said lower bearing block and said upper bearing block, said at least one elastic element being disposed between said lower bearing block and said housing.

16. The tilt mechanism according to claim 9, wherein the tilt mechanism allows various tilt directions each having a maximum tilt angle, and the maximum tilt angles for the various directions differ from each other.

* * * * *